US009902921B2

(12) United States Patent
Reinhardt et al.

(10) Patent No.: US 9,902,921 B2
(45) Date of Patent: Feb. 27, 2018

(54) BLEACH CATALYST GRANULES, USE THEREOF AND WASHING CLEANING AGENTS CONTAINING THE SAME

(71) Applicant: WeylChem Wiesbaden GmbH, Wiesbaden (DE)

(72) Inventors: Gerd Reinhardt, Kelkheim (DE); Michael Best, Bad Soden (DE); Miriam Ladwig, Dietzenbach (DE); Andreas Schottstedt, Hofheim (DE); Mathias Groeschen, Waldbrunn-Hintermeilingen (DE); Sven Gebhard, Liederbach (DE)

(73) Assignee: WEYLCHEM WIESBADEN GMBH, Wiesbaden (DE)

( * ) Notice: Subject to any disclaimer, the term of this patent is extended or adjusted under 35 U.S.C. 154(b) by 117 days.

(21) Appl. No.: 14/898,189

(22) PCT Filed: May 9, 2014

(86) PCT No.: PCT/EP2014/001264

§ 371 (c)(1),
(2) Date: Dec. 14, 2015

(87) PCT Pub. No.: WO2014/198368

PCT Pub. Date: Dec. 18, 2014

(65) Prior Publication Data

US 2016/0145541 A1 May 26, 2016

(30) Foreign Application Priority Data

Jun. 15, 2013 (DE) ..... 10 2013 010 150

(51) Int. Cl.

| | |
|---|---|
| ***C11D 3/37*** | (2006.01) |
| ***C11D 3/395*** | (2006.01) |
| ***C11D 3/39*** | (2006.01) |
| ***C11D 3/30*** | (2006.01) |
| ***C11D 3/32*** | (2006.01) |
| ***C11D 17/00*** | (2006.01) |

(52) U.S. Cl.

CPC ..... *C11D 3/3935* (2013.01); *C11D 3/30* (2013.01); *C11D 3/32* (2013.01); *C11D 3/3757* (2013.01); *C11D 3/3761* (2013.01); *C11D 3/391* (2013.01); *C11D 3/392* (2013.01); *C11D 3/3912* (2013.01); *C11D 3/3915* (2013.01); *C11D 3/3917* (2013.01); *C11D 3/3922* (2013.01); *C11D 3/3925* (2013.01); *C11D 3/3942* (2013.01); *C11D 17/0073* (2013.01); *C11D 17/0091* (2013.01)

(58) Field of Classification Search

CPC ..... C11D 3/30; C11D 3/32; C11D 3/3757; C11D 3/391; C11D 3/3912; C11D 3/3915; C11D 3/3917; C11D 3/392; C11D 3/3922; C11D 3/3925; C11D 3/3927; C11D 17/0039; C11D 17/06

USPC ..... 510/311, 312, 313, 349, 376, 476, 441, 510/445

See application file for complete search history.

(56) References Cited

U.S. PATENT DOCUMENTS

| | | | | |
|---|---|---|---|---|
| 5,703,034 | A * | 12/1997 | Offshack | C11D 3/3932 510/220 |
| 5,902,781 | A * | 5/1999 | Painter | C11D 3/38672 510/220 |
| 6,093,343 | A * | 7/2000 | Addison | C11D 3/0084 252/186.33 |
| 6,878,680 | B2 | 4/2005 | Kitko et al. | |
| 8,486,881 | B2 * | 7/2013 | Borchers | C11D 3/3932 510/224 |
| 8,883,704 | B2 | 11/2014 | Borchers et al. | |
| 9,102,903 | B2 * | 8/2015 | Reinhardt | C11D 3/3932 |
| 2002/0165110 | A1 * | 11/2002 | Reinhardt | C11D 3/3932 510/311 |
| 2007/0072787 | A1 * | 3/2007 | Hazenkamp | C11D 3/046 510/446 |
| 2007/0244028 | A1 * | 10/2007 | Schirmer-Ditze | C11D 1/62 510/500 |
| 2010/0249009 | A1 * | 9/2010 | Holderbaum | C11D 3/3932 510/224 |
| 2012/0094889 | A1 * | 4/2012 | Borchers | C11D 3/2075 510/220 |

FOREIGN PATENT DOCUMENTS

| | | | |
|---|---|---|---|
| DE | 102006056248 | A1 | 5/2008 |
| WO | 2003093405 | A2 | 11/2003 |
| WO | 2010115581 | A1 | 10/2010 |

OTHER PUBLICATIONS

International Preliminary Report on Patentability (translation) dated Mar. 3, 2016.
International Search Report dated Jul. 18, 2014.
International Preliminary Report on Patentability dated Dec. 17, 2015 (English translation).

* cited by examiner

*Primary Examiner* — Gregory R DelCotto
(74) *Attorney, Agent, or Firm* — Michael W. Ferrell

(57) ABSTRACT

The invention relates to a bleach catalyst granules containing a metal-containing bleach catalyst, which comprises at least one ligand selected from the group comprising di- or trimethyltriazcyclononanes or derivatives therefrom, and a homo- or copolymer polycarboxylate, salts thereof or partially neutralized having a pH-value of between 3 and 9. Said granules are produced in an anhydrous granulation process, in particular by compacting, the treatment temperature being maintained at below 100° C.

20 Claims, No Drawings

BLEACH CATALYST GRANULES, USE THEREOF AND WASHING CLEANING AGENTS CONTAINING THE SAME

CLAIM FOR PRIORITY

This application is a national phase application of PCT/EP2014/001264 FILED May 9, 2014 which was based on application DE 10 2013 010 150.6 FILED Jun. 15, 2013. The priorities of PCT/EP2014/001264 and DE 10 2013 010 150.6 are hereby claimed and their disclosures incorporated herein by reference.

TECHNICAL FIELD

The present invention relates to bleach catalyst granules and also to their use in washing and cleaning compositions, in particular in dishwasher detergents.

BACKGROUND

Dishwasher detergents incorporate persalts such as perborates and percarbonates for spotless results. To activate these bleaching agents and in order to achieve an improved bleaching effect at wash cycle temperatures of 60° C. or below, dishwasher detergents generally further contain bleach activators or bleach catalysts, and it is particularly the bleach catalysts which have proven to be particularly effective.

Bleach catalysts based on various manganese-containing transition metal complexes are described in EP 0 458 397, EP 0 458 398 and EP 0 530 870 for example. The catalysts described in these applications are characterized in that they comprise at least one ligand from the group of triazacyclononanes. Binuclear oxygen-bridged complexes with manganese or iron as central atom and 1,4,7-trimethyl-1,4,7-triazacyclononane ($Me_3$-TACN) as ligand are particularly preferable.

The complexes referred to are highly active in that very low wash cycle concentrations are needed to ensure complete removal of tea stains from dishware. In most cases, a detergent tablet need only contain 2-8 mg of the complex for this. Bleach catalysts are therefore preferably used in dishwasher detergents in the form of ready-made granules. This is done not only to increase their storage stability but also to ensure homogeneous incorporation of minuscule catalyst quantities into the formulations, in particular in tablet applications.

Bleach catalyst granules and also methods of producing bleach catalyst granules are described in various patent applications. EP 509 787 for instance lays claim to a catalyst granule consisting of 2% manganese catalyst, 84% sodium sulfate and 4% sodium silicate. EP 0 544 440 describes abrasion-resistant granules containing the manganese catalyst, an inert salt from the group of chlorides or carbonates, and also mixtures thereof and a binder from the series of oxidation-stable polymers, alkali metal silicates or saturated fatty acids. DE 2007 039 651 envisages advantages for a granule composed of 0.1 to 30% of a bleach catalyst, 10 to 99% of a carrier material which carbonates and silicates, and also 0.1 to 5% of a binder from the group of organic polymers. The binder (polymer) is employed in the granulating step in the form of a solution or dispersion in water or an organic solvent.

WO 95/06710 and WO 95/06711 describe granules which, in addition to the catalyst, contain an inert material (zeolite or silicate) and binders from the groups of silicone oils, waxes, fatty acids/soaps or ethoxylated fatty alcohols or polyglycols, preferably with a melting point of 30 to 100° C.

WO 97/16521 lays claim to catalyst-containing particles comprising 40 to 99% of a carrier/binder having a melting point of 38 to 77° C., preferably selected from the group of polyethylene glycols, paraffin waxes or mixtures thereof.

WO 03/093405 describes co-granules consisting of a bleach catalyst, a bleach activator and, optionally, a coating. As shown in Example 1 of said application, a manganese(II) complex, a TAED powder and a tallow fatty alcohol ethoxylate (Genapol® T500, Clariant) are mixed in a Lödige mixer at 40 to 50° C. and then pressed by an extruder into noodle-shaped granules. WO 2010/115581 describes co-granules containing a) one or more bleach activators, b) one or more bleach catalysts and c) at least 5 wt % of one or more organic acids. Fatty acids, alcohol ethoxylates or polymers are referred to as possible binders. Judging by the examples, the preferred binder is Genapol® T500.

It transpires that granules based on fatty acids/soaps, silicone oils or waxes no longer meet the high requirements expected of a modern granular material for use in dishwasher detergents. At the comparatively low washing temperatures used today and in the short wash cycles, these granules no longer dissolve fast enough to fully release the catalyst, and thereby do not provide an adequate cleaning performance.

It further transpires that, surprisingly, granules containing $[Mn^{IV}_2(\mu\text{-}O)_3(Me\text{-}TACN)_2](PF_6)_2.H_2O$ or related compounds which have a triazacyclononane ring and contain one or more polyethylene glycols or fatty alcohol ethoxylates as carrier/binder will have a distinct amine odor after a certain storage period, and therefore are unsuitable for any commercial use in household products. It is believed that a certain proportion of the manganese complex decomposes during production and/or storage of the granules, releasing the ligand trimethyltriazacyclononane (TACN) or $Me_3$-TACN, which has a pronounced amine-type odor. A similar observation is made on using aqueous solutions of polyacrylates as binders in the granulating step and then drying the granular material at elevated temperature. It is believed in this case that there are interactions of the acid function with the catalyst wherein some of the catalyst is decomposed or converted into an acid-overbridged variant of the original catalyst, and therefore no longer has the full efficacy.

SUMMARY OF THE INVENTION

It is an object of the present invention to provide catalyst granules containing a bleach catalyst comprising at least one ligand from the group consisting of di- or trimethyltriazacyclononanes or derivatives thereof and a binder that on storage in alkaline washing and cleaning compositions are chemically stable, do not have an unpleasant odor and are quick to dissolve in the wash process at temperatures below 50° C. in order to achieve the full cleaning effect of the catalyst.

The present invention accordingly provides bleach catalyst granules containing a metal-containing bleach catalyst comprising at least one ligand from the group consisting of di- or trimethyltriazacyclononanes or derivatives thereof, and a homo- or copolymeric polycarboxylate, in particular a homo- or copolymer based on (meth)acrylic acid, its salts or partial neutralizates having a pH between 3 and 9, characterized in that it is obtained in an anhydrous granulating process, in particular by compaction, wherein the processing temperature is maintained below 100° C.

A preferred bleach catalyst granule of the present invention is characterized in that it is free from alcohol ethoxylates or from derivatives of ethylene oxide or of propylene oxide.

Bleach catalyst granules of the present invention are particularly advantageous with regard to their odor, performance and storage stability—and hence preferable—when they, obtained in an anhydrous granulating process, contain, relative to the overall weight of the granule, a) 0.1 to 50 wt % of one or more metal-containing bleach catalysts comprising at least one ligand from the group consisting of di- or trimethyltriazacyclononane or derivatives thereof, b) 99.9 to 50 wt % of one or more binders based on poly(meth)acrylic acids or their salts with a pH in the range from 3 to 9.

It is particularly preferable for the bleach catalyst granules of the present invention to contain, relative to the overall weight of the granule, a) 2 to 10 wt % of one or more metal-containing bleach catalysts comprising at least one ligand from the group consisting of di- or trimethyltriazacyclononane or derivatives thereof, b) 98 to 90 wt % of one or more binders based on poly(meth)acrylic acids or their salts with a pH in the range from 4 to 8.

DETAILED DESCRIPTION

Bleach Catalysts

Bleach catalysts used in the context of the present invention are preferably bleach-boosting transition metal salts and/or complexes of manganese, of iron, of cobalt, of ruthenium, of molybdenum, of titanium or of vanadium.

Preference is further given to complexes of iron in the oxidation states II or III and of manganese in the oxidation state II, III, IV or IV, which preferably comprise one or more macrocyclic ligands having the donor functions N, NR, PR, O and/or S. Preference is given to using ligands having nitrogen donor functions.

The co-granules of the present invention preferably utilize transition metal complexes comprising mono- or dinuclear complexes of manganese or iron comprising at least one ligand of the general formulae A or B Formula A

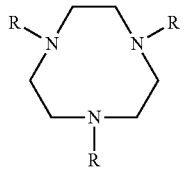

Formula B

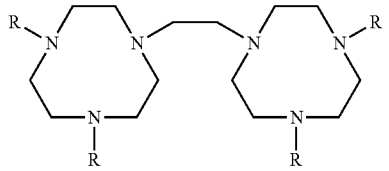

where R═H, $CH_3$, $C_2H_5$, or $C_3H_7$.

Preferred ligands are 1,4,7-trimethyl-1,4,7-triazacyclononane ($Me_3$-TACN), 1,4,7-triazacyclononane (TACN) or bridged ligands such as 1,2-bis-(4,7-dimethyl-1,4,7-triazacyclonono-1-yl)ethane (Me4-DTNE), as described for example in EP 0 458 397, EP 0 458 398, EP 0 549 272, WO 96/06154, WO 96/06157 or WO 2006/125517.

Useful manganese complexes include, for example, the polynuclear complexes $[Mn^{III}_2(\mu\text{-}O)_3(\mu\text{-}OAc)_2(TACN)_2](PF_6)_2$,$[Mn^{IV}_2(\mu\text{-}O)_3(Me_3\text{-}TACN)_2](PF_6)_2$, $[Mn^{IV}_2(\mu\text{-}O)_3(Me_3\text{-}TACN)_2](SO_4)$, $[Mn^{IV}_2(\mu\text{-}O)_3(Me_3\text{-}TACN)_2](OAc)_2$, $[Mn^{IV}_2(\mu\text{-}O)_3(Me_3\text{-}TACN)_2](Cl)_2$, $[Mn^{IV}Mn^{III}_2(\mu\text{-}O)_2(OAc)(Me_4DTE)](Cl)_2$, $[Mn^{IV}Mn^{III}_2(\mu\text{-}O)_2(OAc)(Me_4\text{-}DTE)](PF_6)_{20}$r the mononuclear complexes $[Mn^{IV}(Me_3\text{-}TACN)(OCH_3)_3]PF_6$ (obtained as described in EP 544 519), $[Mn^{IV}(Me_3\text{-}TACN)(OC_2H_5)_3]PF_6$ and $[Mn^{IV}(Me_3\text{-}TACN)(acac)OH]PF_6$ or $[Mn^{III}(Me_3\text{-}TACN)(acac)OC_2H_5]PF_6$, the latter prepared as described by K. Wieghardt et al., Zeitschrift fur Naturforschung 43b, 1184-1194 (1988). Since some of these complexes crystallize in hydrated form (with water of crystallization), these forms are employed with preference, one example thereof being $[Mn^{IV}_2(\mu\text{-}O)_3(Me_3\text{-}TACN)_2](PF_6)_2{*}H_2O$.

Particularly preferred metal-containing bleach catalysts are selected from the group:

$[Mn^{III}_2(\mu\text{-}O)_1(\mu\text{-}OAc)_2(Me_3\text{-}TACN)_2](PF_6)_2$, $[Mn^{IV}_2(\mu\text{-}O)_3\text{-}TACN)_2](PF_6)_2{*}H_2O$, $[Mn^{IV}_2(\mu\text{-}O)_2(\mu\text{-}OAc)(Me_4DTE)]Cl_2$, $[Mn^{IV}(Me_3\text{-}TACN)(OCH_3)_3]PF_6$ or $[Mn^{IV}(Me_3\text{-}TACN)(acac)OCH_3]PF_6$.

Binders

The second ingredient in the bleach catalyst granules of the present invention is a binder to ensure coherence of the individual catalyst particles.

The binder is characterized in that it comprises homo- or copolymeric polycarboxylates, in particular polymers or copolymers of acrylic acid and/or of methacrylic acid (referred to herein as "poly(meth)acrylic acid"), preferably in the form of their salts or in partially neutralized form. A 1% solution in water of the binder used should have a pH of 3 to 9, preferably between 3.5 and 8.5, but especially a pH of 4 to 8. Homo- or copolymeric polycarboxylates, preferably with maleic acid, are concerned here. Polyacrylic acid or polymethacrylic acid for example are preferably used, especially those having an average molar mass of 500 to 70 000 g/mol.

Preference thereamong is given to poly(meth)acrylates, which preferably have an average molar mass of 2000 to 20 000 g/mol. Of this group, it is especially the short-chain poly(meth)acrylates with an average molar masse of 2000 to 10 000 g/mol and preferably of 3000 to 5000 g/mol which are once again preferable by virtue of their superior solubility.

Preference thereamong is further given to copolymeric polycarboxylates, in particular those of acrylic acid with methacrylic acid and of acrylic acid or methacrylic acid with maleic acid. Copolymers of acrylic or methacrylic acid with maleic acid where the acrylic or methacrylic acid content is from 50 to 90 wt % and the maleic acid content is from 50 to 10 wt % have been found to be particularly suitable. Their average molar mass is preferably in the range from 2000 to 70 000 g/mol, more preferably in the range from 20 000 to 50 000 g/mol and most preferably in the range from 30 000 to 40 000 g/mol. Preferred polymers are Sokalan® CP45 and CP5 from BASF in substantially anhydrous form, preferably in powder or granule form.

To improve their solubility in water, the polymers may also contain structural units derived from allyl-sulfonic acids, for example allyloxybenzenesulfonic acid and methallylsulfonic acid. Particular preference is also given to biodegradable polymers formed from more than two different monomer units, for example those containing structural units derived from salts of acrylic and/or methacrylic acid and maleic acid and also from vinyl alcohol and/or vinyl alcohol derivatives and sugar derivatives, or structural units derived from salts of acrylic and/or methacrylic acid and 2-alkylallylsulfonic acid and from sugar derivatives.

Preferred copolymers further include those containing structural units derived from acrolein and acrylic acid/acrylic acid salts or methacrylic acid/methacrylic acid salts, and/or acrolein and vinyl acetate.

Anionic polymers employed with preference as binders further include sulfonated polymers, in particular copolymers formed from unsaturated carboxylic acids, sulfonated monomers with or without further ionogenic or nonionogenic monomers.

Optional Adjunct Materials:

The co-granules of the present invention may contain adjunct materials known to boost the efficacy of the TACN-containing bleach catalyst. Examples thereof include particularly oxalic acid, ascorbic acid and glyoxalic esters and their acetals or hemiacetals.

In the simplest embodiment of the invention, the bleach catalyst granule of the invention does not have a coating in the form of a protective layer.

In one preferred embodiment of the invention, the bleach catalyst granule of the invention does additionally have a coating in the form of a protective layer to further improve the storage stability and to allow the bleach catalyst granule to be provided with color, if so desired. The proportion of the overall granule which is accounted for by the protective or coating layer should then be not less than 5 wt %, more preferably not less than 7 wt % and most preferably not less than 15 wt %. There is an upper limit to the proportion of the overall granule which is accounted for by the protective or coating layer and preferably it is 30 wt %.

Preference for use as coating layer is given to solid organic compounds having film-forming properties, e.g., waxes, polyvinyl alcohols or the substances already used as binders. Optionally, the coating layer may additionally contain small amounts of water-soluble or water-insoluble organic dyes.

Producing the co-granules of the present invention Various anhydrous methods of granulation are possible in principle for providing the co-granules of the present invention. Anhydrous in this case is to be understood as meaning that no water is added in the granulating step and no aqueous solution of the component(s) is used, but that water can be present in the catalyst and/or binder in the form of water of crystallization.

A further preferred embodiment comprises the pulverulent actives first being mixed and the mixture then being compacted, thereafter ground with or without subsequent sieving into individual particle size fractions. The compacting is preferably effected on so-called roll compactors (e.g., from Hosokawa-Bepex, Alexanderwerk, Köppern). The roll profile can be varied to produce either pellets or briquettes or a compacted sheet. While it typically merely remains to separate the piece compacts from the fines, the sheet compact has to be comminuted in a mill down to the desired size of particle. Typically, the types of mill used are preferably of the gentle type, for example sieve and hammer mills (e.g., from Hosokawa-Alpine, Hosokawa-Bepex) or roll stands (e.g., from Bauermeister, Bühler).

The granule material thus obtained is sieved to remove the undersize fraction and, if present, the oversize fraction. The oversize fraction is recycled to the mill, whereas the undersize fraction is recycled into the compaction process. The granules can be classified using commonplace sieving machines such as, for example, tumble or vibration sieves (e.g., from Allgaier, Sweco, Vibra).

The bleach catalyst granules of the present invention are primarily characterized by their chemical composition. It has nonetheless been found that the bleaching effect of these bleach catalyst granules can also be advantageously influenced by influencing physical parameters such as, for example, the corpuscle size, the fines fraction and also the bleach catalyst content of selected sieved fractions.

Preferred bleach catalyst granules of the present invention are accordingly characterized in that they have an average corpuscle size between 0.1 and 1.6 mm, preferably between 0.2 and 1.2 mm and more preferably between 0.3 and 1.0 mm, as measured by sieve analysis.

The co-granules of the present invention are suitable for use in any washing or cleaning compositions, although their use in dishwasher detergents has been found to be particularly advantageous.

It is believed that the organic acid in the bleach catalyst granules of the present invention performs a protective function and prevents the reaction of alkaline constituents of the washing composition with the non-alkali-resistant and hydrolysis-sensitive bleach activators and bleach catalysts of the bleach catalyst granules according to the present invention.

The present invention accordingly further provides the a bleach catalyst granule of the present invention in the manufacture of washing and cleaning compositions and preferably in the manufacture of dishwasher detergents.

The present invention further also provides washing and cleaning compositions, preferably dishwasher detergents, comprising a bleach catalyst granule of the present invention.

Preferred washing and cleaning compositions according to the present invention, in particular the dishwasher detergents, incorporate the bleach catalyst granules of the present invention in amounts between 0.1 and 10 wt %, preferably in amounts between 0.2 and 8 wt % and more preferably in amounts between 0.5 and 6 wt %.

The washing and cleaning compositions of the present invention, in particular the dishwasher detergents, which may be in the form of granules or in the form of pulverulent or tablet-shaped solids, but also in liquid or pasty form, may incorporate in principle any known and customary (in such compositions) ingredients in addition to the co-granule of the present invention. The washing and cleaning compositions of the present invention, in particular the dishwasher detergents, may more particularly incorporate builder substances, peroxygen compounds, enzymes, alkali carriers, surfactants, pH regulators, organic solvents and further, auxiliary materials, such as glass corrosion inhibitors, silver corrosion inhibitors and foam regulators. The bleach catalyst granules of the present invention are useful in both phosphate-containing and phosphate-free formulations.

Particularly preferred washing and cleaning compositions, in particular dishwasher detergents, incorporate i) 15 to 65 wt %, preferably 20 to 60 wt % of a water-soluble builder component,
ii) 5 to 25 wt %, preferably 8 to 17 wt %, of a peroxygen compound,
iii) 0.5 to 6 wt % of a bleach catalyst granule of the invention, and
iv) 0 to 54 wt % of further components such as enzymes, alkali carriers, surface active surfactants, pH regulators, organic solvents glass corrosion inhibitors, silver corrosion inhibitors and foam regulators, all relative to the overall weight of the washing and cleaning composition.

A composition of this type is specifically of low alkalinity, i.e., its 1 weight percent solution has a pH in the range of 8 to 11.5, preferably of 9 to 11.

Water-Soluble Builder Component and/or Substances

Water-soluble builder components for use in the washing and cleaning compositions of the present invention, in particular the dishwasher detergents, include in principle any builders typically used in such compositions, for example alkali metal phosphates, which may be in the form of their alkaline, neutral or acidic sodium or potassium salts. Examples thereof are trisodium phosphate, tetrasodium diphosphate, disodium dihydrogendiphosphate, pentasodium triphosphate, so-called sodium hexametaphosphate and also the corresponding potassium salts and/or mixtures of sodium and potassium salts. Their amounts may range up to about 60 wt %, preferably from 5 to 20 wt %, relative to the overall composition. Possible water-soluble builder components further include not only polyphosphonates and phosphonatoalkyl carboxylates but also, for example, organic polycarboxylate polymers of natural or synthetic origin which act as co-builders in hard-water regions in particular. Possibilities include, for example, polyacrylic acids and copolymers formed from maleic anhydride and acrylic acid, and also the sodium salts of these polymeric acids. Commercially available products include, for example, Sokalan™ CP 5, CP 10 and PA 30 from BASF. Useful co-builder polymers of natural origin include, for example, oxidized starch and polyamino acids such as polyglutamic acid or poly-aspartic acid. Possible water-soluble builder components further include naturally occurring hydroxy carboxylic acids such as, for example, monohydroxy-succinic acid, dihydroxysuccinic acid, alpha-hydroxy-propionic acid and gluconic acid. The preferred organic water-soluble builder components include the salts of citric acid, in particular sodium citrate. Sodium citrate is anhydrous trisodium citrate and preferably trisodium citrate dihydrate. Trisodium citrate dihydrate is employable as finely or coarsely crystalline powder. Depending on the ultimate pH established in the washing and cleaning compositions of the present invention, in particular the dishwasher detergents, acids corresponding to the co-builder salts referred to may also be present. Particularly preferred builder components in phosphate-free formulations include methylglycine diacetate (MDGA, e.g., Trilon® M, BASF), L-glutamic acid, N,N-(biscarboxymethyl), tetrasodium salt (GLDA, Dissolvine® DL, Akzo Nobel), sodium polyaspartates (Baypure®, Lanxess) or salts of iminodisuccinic acid (Baypure®, Lanxess).

Peroxygen Compounds

Preferred peroxygen compounds are perborates and percarbonates, in particular the corresponding sodium salts thereof.

Enzymes

The enzymes optionally incorporated in the washing and cleaning compositions of the present invention, in particular the dishwasher detergents, include proteases, amylases, pullulanases, cutinases and/or lipases, for example proteases such as BLAP™, Optimase™, Opticlean™, Maxacal™, Maxapem™, Durazym™, Purafect™ OxP, Esperase™ and/or Savinase™, amylases such as Termamyl™, Amylase™, Maxamyl™, Duramyl™ and/or lipases such as Lipolase™, Lipomax™, Lumafast™ and/or Lipozym™. The enzymes used may be in a state of adsorption on carrier materials and/or embedment in enveloping substances in order that they may be protected against premature deactivation. They are incorporated in the washing and cleaning compositions of the present invention, in particular the dishwasher detergents, at preferably up to 10 wt % and more preferably at from 0.05 to 5 wt %, with particular preference in the form of enzymes stabilized against oxidative degradation.

Alkali Carriers

The washing and cleaning compositions of the present invention, in particular the dishwasher detergents, preferably incorporate the usual alkali carriers such as, for example, alkali metal silicates, alkali metal carbonates and/or alkali metal bicarbonates. The alkali carriers typically used include carbonates, bicarbonates, and alkali metal silicates having an $SiO_2/M_2O$ (M=alkali metal atom) molar ratio of 1:1 to 2.5:1. The alkali metal silicates may be incorporated at up to 40 wt %, in particular at from 3 to 30 wt %, relative to the overall composition. The alkali carrier system whose use in the washing and cleaning compositions of the present invention, in particular the dishwasher detergents, is preferred as a mixture of carbonate and bicarbonate, preferably sodium carbonate and sodium bicarbonate, and said mixture may be incorporated at up to 50 wt % and preferably at from 5 to 40 wt %.

In a further preferred embodiment of the invention, the washing and cleaning compositions of the invention, in particular the dishwasher detergents, incorporate from 20 to 60 wt % of water-soluble organic builders, in particular alkali metal citrate, from 3 to 20 wt % of alkali metal carbonate and from 3 to 40 wt % of alkali metal disilicate.

Surfactants

The washing and cleaning compositions of the present invention, in particular the dishwasher detergents, may optionally also incorporate surfactants, in particular anionic surfactants, zwitterionic surfactants and preferably low-sudsing nonionic surfactants, added for better detachment of greasy stains, as wetting agents and possibly as granulation assistants in the manufacture of these compositions. Their amount may be up to 20 wt %, preferably up to 10 wt %, and more preferably is in the range from 0.5 to 5 wt %. Dishwasher detergents in particular typically utilize extremely low-foam compounds. These preferably include $C_{12}$-$C_{18}$ alkyl polyethylene glycol polypropylene glycol ethers each containing up to 8 mol of ethylene oxide and propylene oxide units in the molecule. However, it is also possible to use other renowned low-foam nonionic surfactants, for example $C_{12}$-$C_{18}$ alkyl polyethylene glycol polybutylene glycol ethers each containing up to 8 mol of ethylene oxide and butylene oxide units in the molecule, end capped alkyl polyalkylene glycol mixed ethers and also the admittedly sudsing, but ecologically attractive $C_8$-$C_{14}$ alkylpolyglucosides having a degree of polymerization of about 1 to 4 and/or $C_{12}$-$C_{14}$ alkyl polyethylene glycols having 3 to 8 ethylene oxide units in the molecule. Suitable are likewise surfactants from the family of glucamides such as, for example, alkyl-N-methyl-glucamides in which the alkyl moiety preferably derives from a fatty alcohol having a carbon chain length of $C_6$-$C_{14}$. It is advantageous in some instances when the surfactants described are employed in the form of mixtures, for example the combination of alkylpolyglycoside with fatty alcohol ethoxylates or glucamide with alkylpolyglycosides. The presence of amine oxides, betaines and ethoxylated alkylamines is also possible.

pH Regulators

To establish a desired pH when not automatically resulting from mixing the other components, the washing and cleaning compositions of the present invention, in particular the dishwasher detergents, may incorporate system-compatible and environmentally compatible acids, in particular citric acid, acetic acid, tartaric acid, malic acid, lactic acid, glycolic acid, succinic acid, glutaric acid and/or adipic acid, but also mineral acids, in particular sulfuric acid or alkali metal hydrogensulfates, or bases, in particular ammonium hydroxide or alkali metal hydroxides. The level of pH regulators of this type in the washing and cleaning compositions of the present invention, in particular the dishwasher detergents, preferably does not exceed 10 wt % and more preferably is in the range from 0.5 to 6 wt %.

Organic Solvents

Organic solvents useful in the washing and cleaning compositions of the present invention, in particular the dishwasher detergents, in particular when these are in liquid or pasty form, include alcohols of 1 to 4 carbon atoms, in particular methanol, ethanol, isopropanol and tert-butanol, diols of 2 to 4 carbon atoms, in particular ethylene glycol and propylene glycol, and also mixtures thereof, and the ethers derivable from the recited classes of compounds. The level of such water-miscible solvents in the washing and cleaning compositions of the present invention, in particular dishwasher detergents, preferably does not exceed 20 wt % and more preferably is in the range from 1 to 15 wt %.

Glass Corrosion Inhibitors

To inhibit glass corrosion during the wash cycle, the washing and cleaning compositions of the present invention, in particular the dishwasher detergents, may incorporate glass corrosion inhibitors. Crystalline layered silicates and/or zinc salts are particularly advantageous here. Crystalline layered silicates are available for example from Clariant under the trade name of Na-SKS, e.g. Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$) or Na-SKS-4 ($Na_2Si_4O_9.xH_2O$, makatite). Suitable among these are in particular Na-SKS-5 (alpha-$Na_2Si_2O_5$), Na-SKS-7 (beta-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$) and Na-SKS-13 ($NaHSi_2O_5$), but in particular Na-SKS-6 (delta-$Na_2Si_2O_5$. An overview of crystalline sheet-silicates is found, for example, in the article published in "Seifen-Öle-Fette-Wachse, 116 volume, No. 20/1990", on pages 805-808.

In a further preferred embodiment of the invention, the washing and cleaning compositions of the present invention, in particular the dishwasher detergents, incorporate the crystalline layered silicate at preferably 0.1 to 20 wt %, more preferably 0.2 to 15 wt % and more preferably 0.4 to 10 wt %, all relative to the overall weight of the composition.

To control glass corrosion, washing and cleaning compositions of the present invention, in particular dishwasher detergents, may incorporate at least one zinc or bismuth salt, preferably selected from the group of organozinc salts, more preferably selected from the group of soluble organozinc salts, yet more preferably selected from the group of soluble zinc salts of monomeric or polymeric organic acids and yet still more preferably selected from the group consisting of zinc acetate, zinc acetylacetonate, zinc benzoate, zinc formate, zinc lactate, zinc gluconate, zinc oxalate, zinc ricinoleate, zinc abietate, zinc valerate and zinc p-toluenesulfonate. Bismuth salts such as, for example, bismuth acetates are employable as an alternative to or in combination with these zinc salts.

Preference in the context of the present invention is given here to washing and cleaning compositions, in particular dishwasher detergents, where the amount of zinc salt, relative to the overall weight of this composition, is from 0.1 to 10 wt %, preferably from 0.2 to 7 wt % and more preferably from 0.4 to 4 wt %, irrespective of which zinc salts are used, specifically irrespective that is as to whether organic or inorganic zinc salts, soluble or insoluble zinc salts or mixtures thereof are used.

Silver Corrosion Inhibitors

Silver corrosion inhibitors may be incorporated in the washing and cleaning compositions, in particular dishwasher detergents, of the invention for silver corrosion control. Preferred silver corrosion inhibitors are organic sulfides such as cystine and cysteine, di- or trihydric phenols, optionally alkyl- or aryl-substituted triazoles such as benzotriazole, isocyanuric acid, salts and/or complexes of titanium, of zirconium, of hafnium, of cobalt or of cerium wherein the metals referred to are present in one of the oxidation states II, III, IV, V or VI, depending on the metal.

Foam Regulators

When the washing and cleaning compositions of the invention, in particular the dishwasher detergents, are prone to excessive sudsing in use in the presence of anionic surfactants, for example, they may be additionally additized with up to 6 wt %, preferably about 0.5 to 4 wt %, of a foam-suppressing compound, preferably from the group of silicone oils, mixtures of silicone oil and hydrophobicized silica, paraffins, paraffin-alcohol combinations, hydrophobicized silica, bisfatty acid amides, and other further known commercially available defoamers.

Further possible ingredients for the washing and cleaning compositions of the present invention, in particular the dishwasher detergents, include, for example, the sequestrants, electrolytes, additional peroxygen activators, dyes or fragrances such as, for example, perfume oils that are familiar from the prior art relating to such compositions.

Producing the Washing and Cleaning Compositions of the Invention

The production of solid washing and cleaning compositions of the present invention, in particular the dishwasher detergents, does not present any difficulties and may in principle be carried out in a known manner, for example by spray-drying or granulation, in which case the peroxygen compound and the bleach catalyst granule material of the present invention are optionally added separately at a later stage.

The anhydrous granulating process of the present invention is carried out at temperatures below 100° C., in particular at temperatures between 25 and 90° C.

A particularly advantageous way to produce those washing and cleaning compositions of the present invention which take the form of aqueous solutions or of solutions containing other customary solvents, in particular such dishwasher detergents, is to simply mix the ingredients, which may be introduced into an automatic mixer in the form of a solution or without a solvent.

The washing and cleaning compositions, in particular dishwasher detergents, of the present invention preferably take the form of pulverulent, granular or tableted preparations obtainable in a known manner, for example by mixing, granulating, roll compacting and/or spray drying the thermally robust components and subsequently admixing the more sensitive components, which must be considered to include specifically enzymes, bleaching agents and the bleach catalyst.

To produce washing and cleaning compositions, in particular dishwasher detergents, of the present invention in tablet form, a preferable procedure involves mixing all the constituents with one another in a mixer and using conventional tableting presses, for example eccentric presses or rotary presses, to mold the mixture using molding pressures in the range from $200\times10^5$ Pa to $1500\times10^5$ Pa.

The tablets thus obtained in a straightforward manner, which normally have flexural strengths of above 150 N, are fracture-resistant but will nonetheless dissolve sufficiently rapidly under the intended conditions of service. A tablet thus obtained preferably combines a weight of 15 to 40 g, in particular 20 to 30 g, with a diameter of 35 to 40 mm.

Those washing and cleaning compositions of the present invention which take the form of nondusting, storage-stably free-flowing powders and/or granules having high bulk densities in the range from 800 to 1000 g/l, in particular such dishwasher detergents of the present invention, are obtainable in a process wherein, in a first subsidiary step of the process, the builder components are mixed with at least a proportion of liquid mixing components to increase the bulk density of this pre-mix and then—if desired after an intervening drying operation—the further constituents of the composition, including the bleach catalyst granule of the present invention, are combined with the pre-mix thus obtained.

Dishwasher detergents of the present invention are useful not only in domestic dishwashers but also in industrial/institutional dishwashers. They are added by hand or by means of suitable dosing devices. The use concentrations in the cleaning liquor are generally about 1 to 8 g/l, preferably 2 to 5 g/l.

In a dishwasher generally, the actual wash cycle is advantageously followed by several intermediate rinse cycles with clear water and a final rinse cycle with a customary rinse aid. The dishes obtained after drying are spotlessly clean and hygienically impeccable when dishwasher detergents according to the present invention are used.

EXAMPLES

In the examples which follow, % ages are weight percent (wt %) unless specifically stated otherwise. As regards the reported relative humidities, the % ages have the usual meaning.

Comparative Granule 1 (V1):

Preparation of $[Mn^{IV}_2(\mu\text{-}O)_3(Me_3\text{-}TACN)_2](PF_6)_2.H_2O$ Granules with Fatty Alcohol Ethoxylate as Binder 10 g of $[Mn^{IV}_2(\mu\text{-}O)_3(Me_3\text{-}TACN)_2](PF_6)_2.H_2O$ were charged to a laboratory mixer and heated therein to the requisite starting temperature of T>40° C. Then, a melt of 200 g of Genapol® T 500 (fatty alcohol polyglycol ether, commercial product from Clariant)—was added at a temperature of T=70-75° C. under intensive agitation.

The mixture was postgranulated for some minutes, then cooled down to room temperature and sieved to remove coarse and fine fractions from 200-1600 μm. The granules had a bright red color.

Comparative Granule 2 (V2):

Preparation of $[Mn^{IV}_2(\mu\text{-}O)_3(Me_3\text{-}TACN)_2](PF_6)_2.H_2O$ Granules with Sokalan® CP 13 as Binder 20 g of $[Mn^{IV}_2(\mu\text{-}O)_3(Me\text{-}TACN)_2](PF_6)_2.H_2O$ were initially charged to a laboratory mixer and mixed therein. Then, an aqueous solution of a polyacrylate (Sokalan CP 13, commercial product from BASF) was added under intensive agitation and the mixture was granulated. The moist co-granule material was dried in a laboratory moving-bed dryer at about 60-80° C. and subsequently sieved to remove coarse and fine fractions from 200-1600 μm. The granules had a bright red color.

Even in its as-produced state, the co-granule material already had an unpleasant odor.

Examples 1 to 4

Preparation of Inventive Granules 1 to 4

The bleach catalyst granules were produced under anhydrous conditions with the binders being employed in The form of their powders or granules. In a preferred production process the commercially available binder granules were initially ground down to a particle size of 200 to 1000 μm.

The pulverulent bleach catalysts 1 to 3 and solid binder were mixed in an Eyrisch mixer in the amounts reported in table 1 and the mixture was subsequently compacted using a Bepex laboratory compactor. The resulting sheet compacts were comminuted in an Alexanderwerk sieve mill to 1.25 mm and fractionally sieved at 200 to 1040 μm using a Sweco sieve. Batch size: 5 to 7 kg. The granules had a bright red color.

Table I hereinbelow shows an overview of inventive granules 1 to 4.

TABLE I

| | Granule | | | |
|---|---|---|---|---|
| | 1 | 2 | 3 | 4 |
| Substances | | | | |
| Bleach catalyst *) | complex 1 | complex 1 | complex 2 | complex 3 |
| Binder | Sokalan ® CP 45 G | Sokalan ® CP 5 G | Sokalan ® CP 45 G | Sokalan ® CP 45 G |
| Composition | | | | |
| Bleach catalyst [%] | 10 | 10 | 5 | 2 |
| Binder [%] | 90 | 90 | 95 | 98 |
| Molding force [kN] | 33-55 | 55-58 | 55-56 | 50-63 |

*) complex 1 $[Mn^{IV}_2(\mu\text{-}O)_3(Me_3\text{-}TACN)_2](PF_6)_2\bullet H_2O$, prepared as per EP 0 458 397
*) complex 2 $[Mn^{IV}_2(\mu\text{-}O)_3(Me_3\text{-}TACN)_2](OAc)_2$, prepared as per WO 2006/125517
*) complex 3 $[Mn^{IV}(Me_3\text{-}TACN)](OCH_3)_2(PF_6)$, prepared as per EP 0 544 519
Sokalan ® CP copolymers of acrylic acid, commercial product from BASF Testing of Granules Obtained 1. Storage Test of Granules in Base Laundry Detergent Powder To test the chemical and physical stability of the granules thus obtained, its storage behavior was investigated in a typical laundry detergent powder formulation. To this end, the particular granule was incorporated in IEC-A base laundry detergent powder such that the final formulation contained 1% of granule. The mixture was transferred into a glass bottle and stored for several days with a closed lid under climatic conditions (T=40° C., 75% relative humidity). The parameters evaluated were the color of the granule and the odor of the laundry detergent powder mixture after 14 days.

2. Hygroscopicity of Granules

The granules were stored at constant humidity (65% rH) for 3 h and thereafter the water uptake was determined gravimetrically and the flow properties of the granule material were evaluated.

3. Bleaching Performance 20 g of the IEC-C dishwasher detergent were admixed in each case with appropriate amounts of the unstored granules V1, V2 and/or granules 1 to 4 such that the formulation in each case contained 4 mg of bleach catalyst (reckoned as 100% active). The formulations were used to wash 6 teacups (stained according to the IKW test protocol) in each case in an automatic dishwasher (Miele G 688 SC) as per the IKW test protocol (IKW test method; (SOFW, 132(8), 2006, 35-49) in the 45° C.-delicate wash cycle. The assessment was by visual inspection; 0% performance=no tea stain removal, 100% performance: complete removal of tea stain. The runs were repeated 3 times in each case and averaged. The pH in the dishwasher was measured during the cleaning cycle.

Table II hereinbelow shows an overview of the test results.

TABLE II

| | Granule | | | | | |
|---|---|---|---|---|---|---|
| Storage test | V1 | V2 | 1 | 2 | 3 | 4 |
| Color of granule | brown | colorless | OK | OK | OK | OK |
| Odor | amine-type | amine-type | OK | OK | OK | OK |
| Water uptake [%] | 0 | 13 clumped | 0 | 25 free-flowing | 1 | 0 |
| Bleaching performance [%] | 56 | 32 | 100 | 95 | 98 | 93 |

It transpired that Comparative Granule V1 is unstable during storage in that the brown coloring and odor of the mixture following storage point to decomposition of the granule. In addition, the (unstored) granule gave a poor bleaching performance. The picture is similar for Comparative Granule V2. The decoloration of the granule, the appearance of the amine-type odor and the inadequate bleaching performance make such a granule appear unsuitable for use in consumer products. Inventive Granules 1 to 4, by contrast, are distinctly superior to the comparative granules not only in storage behavior but also in use. Granule 2, in which Sokalan® CP5 was used as binder, does admittedly have a hygroscopic tendency, but that does not have adverse repercussions for the product properties.

What is claimed is:

1. A bleach catalyst granule containing 0.01 to 50 wt %, relative to the overall weight of the granule, of a metal-containing bleach catalyst comprising at least one ligand from the group consisting of di- or trimethyltriazacyclononanes or derivatives thereof, and 50 to 99.9 wt %, relative to the overall weight of the granule, of a homo- or copolymer of (meth)acrylic acid or its salts or partial neutralizates having a pH between 3 and 9, as measured on a 1 wt % solution in water, characterized in that the granule is obtained in an anhydrous granulating process, wherein the processing temperature is maintained below 100° C.

2. The bleach catalyst granule as claimed in claim 1, characterized in that the granule is free from alcohol ethoxylates or from derivatives of ethylene oxide or of propylene oxide.

3. The bleach catalyst granule as claimed in claim 1, characterized in that the granule contains a) a metal-containing bleach catalyst comprising at least one ligand of formula A or B Formula A

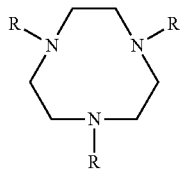

-continued

Formula B

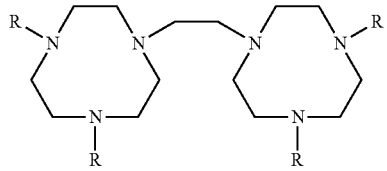

where R=H, $CH_3$, $C_2H_5$, or $C_3H_7$ and b) a homo- or copolymer of (meth)acrylic acid, its salts or partial neutralizates having a pH of 3 to 9, as measured on a 1 wt % solution in water.

4. The bleach catalyst granule as claimed in claim 1, characterized in that the metal-containing bleach catalyst is selected from the group consisting of manganese complexes comprising at least one ligand of formula A or B Formula A

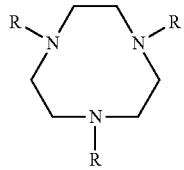

Formula B

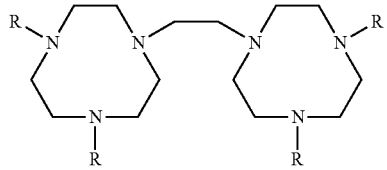

where R=H, $CH_3$, $C_2H_5$, or $C_3H_7$.

5. The bleach catalyst granule as claimed in claim 1, characterized in that the bleach catalyst is selected from the group consisting of:

$[Mn^{III}_2(\mu\text{-}O)_1(\mu\text{-}OAc)_2(TACN)_2](PF_6)_2$, $[Mn^{IV}_2(\mu\text{-}O)_3(Me_3\text{-}TACN)_2](PF_6)_2.H_2O$, $[Mn^{IV}_2(\mu\text{-}O)_2(\mu\text{-}OAc)(Me_4\text{-}DTE)]Cl_2$, $[Mn^{IV}(Me_3\text{-}TACN)(OCH_3)_3]PF_6$ and $[Mn^{IV}(Me_3\text{-}TACN)(acac)OCH_3]PF_6$.

6. The bleach catalyst granule as claimed in claim 1, characterized in that it has a protective or coating layer, wherein the proportion of the overall granule which is accounted for by the protective or coating layer is not less than 5 wt %, but not more than 30 wt %.

7. The bleach catalyst granule as claimed in claim 1, characterized in that it has an average particle size between 0.1 and 1.6 mm, as measured by sieve analysis.

8. A method of using bleach catalyst granule material as claimed in claim 1 comprising utilizing the material in combination with an inorganic persalt as a bleaching agent in washing and cleaning compositions.

9. A washing and cleaning composition, in particular a dishwasher detergent, incorporating i) 15 to 65 wt % of a water-soluble builder component, ii) 5 to 25 wt % of a peroxygen compound, iii) 0.5 to 6 wt % of a bleach catalyst granule as claimed in claim 1, and iv) 0 to 54 wt % of further components selected from the group consisting of enzymes, alkali carriers, surfactants, pH regulators, organic solvents, glass corrosion inhibitors, silver corrosion inhibitors, and foam regulators, all relative to the overall weight of said washing and cleaning composition.

10. The washing and cleaning composition as claimed in claim 9, characterized in that it is of low alkalinity, its 1 weight percent solution has a pH of 8 to 11.5.

11. The washing and cleaning composition as claimed in claim 9, characterized in that it is in the form of a water soluble tablet having a flexural strength of greater than 150 N combined with a weight of 15 to 40 g, coupled with a diameter of 35 to 40 mm.

12. The bleach catalyst granule as claimed in claim 1, characterized in that it is obtained in an anhydrous granulating process comprising compaction.

13. The bleach catalyst granule as claimed in 1, characterized in that it has a protective or coating layer, wherein the proportion of the overall granule which is accounted for by the protective or coating layer is not less than 7 wt %, but not more than 30 wt %.

14. The bleach catalyst granule as claimed in 1, characterized in that it has a protective or coating layer, wherein the proportion of the overall granule which is accounted for by the protective or coating layer is not less than 15 wt %, but not more than 30 wt %.

15. The bleach catalyst granule as claimed in claim 1, characterized in that it has an average particle size between 0.2 and 1.2 mm, as measured by sieve analysis.

16. The bleach catalyst granule as claimed in claim 1, characterized in that it has an average particle size between 0.3 and 1.0 mm, as measured by sieve analysis.

17. The method of using bleach catalyst granule material as claimed in claim 8, comprising utilizing the material in combination with sodium percarbonate, as a bleaching agent for use in washing and cleaning compositions.

18. The method of using bleach catalyst granule material as claimed in claim 8, comprising utilizing the material in combination with an inorganic persalt as a bleaching agent in dishwasher detergents.

19. The washing and cleaning composition as claimed in claim 9, characterized in that a 1 weight percent solution has a pH of 9 to 11.

20. The washing and cleaning composition as claimed in claim 9, characterized in that it is in the form of a water soluble tablet having a flexural strength of greater than 150 N combined with a weight of 20 to 30 g, coupled with a diameter of 35 to 40 mm.

* * * * *